US010100382B2

(12) United States Patent
Shin et al.

(10) Patent No.: US 10,100,382 B2
(45) Date of Patent: Oct. 16, 2018

(54) COPPER FERROUS ALLOY FOR SHIELDING ELECTROMAGNETIC WAVES AND METHOD FOR PREPARING THE SAME

(71) Applicant: KC GLASS & MATERIALS CO., LTD., Cheonan-si, Chungcheongnamdo (KR)

(72) Inventors: Jungouk Shin, Seoul (KR); Joongpil Shin, Seoul (KR)

(73) Assignee: KC GLASS & MATERIALS CO., LTD., Cheonan-si, Chungcheongnam-do (KR)

( * ) Notice: Subject to any disclaimer, the term of this patent is extended or adjusted under 35 U.S.C. 154(b) by 431 days.

(21) Appl. No.: 14/917,192

(22) PCT Filed: Sep. 4, 2014

(86) PCT No.: PCT/KR2014/008317

§ 371 (c)(1),
(2) Date: Mar. 7, 2016

(87) PCT Pub. No.: WO2015/034283

PCT Pub. Date: Mar. 12, 2015

(65) Prior Publication Data

US 2016/0215357 A1 Jul. 28, 2016

(30) Foreign Application Priority Data

Sep. 6, 2013 (KR) ..... 10-2013-0106908

(51) Int. Cl.
*C21D 9/00* (2006.01)
*B22D 27/00* (2006.01)
(Continued)

(52) U.S. Cl.
CPC ..... *C21D 9/0068* (2013.01); *B21B 1/40* (2013.01); *B22D 21/005* (2013.01); *B22D 27/00* (2013.01);
(Continued)

(58) Field of Classification Search
CPC B21B 1/40; B21B 3/00; B21B 21/005; B21B 8/1205; B21B 2265/14;
(Continued)

(56) References Cited

FOREIGN PATENT DOCUMENTS

KR 10-1990-0002983 B1 5/1990
KR 10-0567739 B1 1/2006
(Continued)

OTHER PUBLICATIONS

International Search Report dated Sep. 30, 2014 corresponding to International Application No. PCT/KR2014/008317.

*Primary Examiner* — Lois Zheng
(74) *Attorney, Agent, or Firm* — Hauptman Ham, LLP

(57) ABSTRACT

A rolled foil formed of the Fe—Cu alloy according to an embodiment of the present invention is manufactured to consist of 3 to 30 wt % iron and 70 to 97 wt % copper having a thickness of 100 μm to 10 μm, by casting a molten metal of a Fe—Cu parent alloy and a metal copper into a slab, heat-treating the slab, and roll-milling the heat-treated slab by using a multi-pass rolling mill with the total reduction ratio of 90% or higher. In this regard, the Fe—Cu alloy rolled foil according to the present invention provides an effect of shielding electromagnetic waves of 80 dB or more within high frequencies ranging between 1 GHz to 1.5 GHz.

5 Claims, 2 Drawing Sheets

(51) Int. Cl.

| | |
|---|---|
| ***B21B 1/40*** | (2006.01) |
| ***C22C 9/00*** | (2006.01) |
| ***B22D 21/00*** | (2006.01) |
| ***C21D 8/12*** | (2006.01) |
| ***C22F 1/08*** | (2006.01) |
| *B21B 3/00* | (2006.01) |

(52) U.S. Cl.
CPC ..... *C21D 8/1205* (2013.01); *C21D 8/1222* (2013.01); *C21D 8/1261* (2013.01); *C22C 9/00* (2013.01); *C22F 1/08* (2013.01); *B21B 3/00* (2013.01); *B21B 2265/14* (2013.01)

(58) Field of Classification Search
CPC .. C21D 8/1205; C21D 8/1222; C21D 8/1261; C21D 9/0068; C21D 9/00; C22F 1/08
See application file for complete search history.

(56) References Cited

FOREIGN PATENT DOCUMENTS

| | | | |
|---|---|---|---|
| KR | 10-0584730 | B1 | 5/2006 |
| KR | 10-0584731 | B1 | 5/2006 |
| KR | 10-1182110 | B1 | 9/2012 |

COPPER FERROUS ALLOY FOR SHIELDING ELECTROMAGNETIC WAVES AND METHOD FOR PREPARING THE SAME

CROSS REFERENCE TO RELATED APPLICATION

This application claims the priority of Korean Patent Application No. 10-2013-0106908, filed on Sep. 6, 2013 in the KIPO (Korean Intellectual Property Office). Further, this application is the National Phase application of International Application No. PCT/KR2014/008317 filed Sep. 4, 2014, which designates the United States and was published in Korean.

BACKGROUND

1. Technical Field

The present invention relates to a copper ferrous (Fe—Cu) alloy for shielding electromagnetic waves and a method for preparing the Fe—Cu alloy, and more particularly, to a Fe—Cu alloy for shielding electromagnetic waves and a method for preparing the Fe—Cu alloy that are used in preparation of a cable having characteristics of shielding electromagnetic waves.

2. Description of the Related Art

In general, cables have a bundle of one or more wires or optical fibers that are insulated and accommodated in a protective cover or a packing. Since wires require high conductivity, low electric resistance, and high traction strength, twisted copper standard wires prepared by twisting several to several tens copper lines having a thickness in a range of about 1 mm to about 5 mm or steel core aluminum wires prepared by twisting steel lines in the center and using aluminum lines around the center line are used as the wires in the cable. Also, in an ultra-high voltage transmission line of 275,000 V primarily includes several bundles of the conducting materials, such as the twisted copper standard wires or the steel core aluminum wires, in the form of a plurality of conducting wires.

The cable is used as an electrical power cable or a controlling cable in the field of information and communication according to its purpose. In the case of using the cable as a controlling cable, electromagnetic waves need to be shielded to prevent generation of noise on electrical signals in the cable caused by electromagnetic waves from the outside and electrostatic force.

Conventionally, an electromagnetic wave shielding technique, in which copper tape or aluminum tape is coated, has been applied to a communication cable. However, despite a general metal material such as copper, aluminum, or iron may shield electromagnetic waves, magnetic waves may not be shielded by a general metal. When iron, not non-ferrous metal, is used in the case of a single core cable, heat is generated by electromagnetic induction, and thus lifespan of the cable may be reduced or deterioration of the cable may be speeded up, as well as a corrosion-resistant property of the cable may be weakened, which requires an additional plating process. Moreover, a technique for shielding electromagnetic waves may include winding with copper tape, and winding with wrought iron tape or winding with wrought iron tape and winding with a copper line, but the technique has problems such as heat generation, an increase in a manufacturing cost of cables due to double tasks, and an increase in a plating cost for preventing corrosion of iron. The shielding effect of the cable produced by using the technique is at a level of 30 dB or lower, but a controlling cable requires at least 40 dB of a shielding level, and the technique may not be used to produce the controlling cable. Also, the technique could not produce a shielding material for an electrode rolled foil having a thickness of about 10 microns.

Examples of the related art in regard of the electromagnetic wave shielding technique include Korean Patent No. 1990-0002983 which discloses 'a lead alloy thin leaf body and a laminated tape for a cable covering', wherein the lead alloy thin leaf body comprises 1 to 4 wt % Sn and 2 to 7 wt % Sb. Despite high corrosion-resistance of a lead alloy, the lead alloy has low conductivity, and thus an electromagnetic wave shielding effect of the lead alloy decreases. Also, Korean Patent No. 10-567739 discloses an aluminum myler tape comprising an aluminum foil layer; a film layer that is stacked and attached on one surface of the aluminum foil layer by using an adhesive layer as a medium; an urethane resin adhesion layer prepared by applying an urethane-based resin solution on an outer surface of the film layer, drying the solution, and heat-seal treating the dried resultant; a bonding layer that is stacked on an outer surface of the urethane resin adhesion layer as a pallet is melted and erupted and thus coats the surface of the urethane resin adhesion layer. However, the aluminum myler tape has a film layer and requires stacking two layers with an adhesive which result complicated manufacturing process, and thus productivity of the aluminum myler tape is deteriorated. Also, the aluminum myler tape has problems such as a gap between layers or almost no electromagnetic wave shielding effect within a low frequency range of about 0.1 MHz to about 100 MHz when copper, aluminum, or iron is used.

In addition, Korean Patent No. 10-1182110 invented by the present inventor discloses a manufacturing method of copper-tape by the rolled copper foil, the method includes the steps of: casting oxygen-free electrolytic copper or tough pitch copper into a first flat plate with a thickness enough to enter a milling roller, reducing the first flat plate at 50% of reduction rate per one-time rolling to obtain a second flat plate with a thickness of 0.5 to 3 mm, heat treating the second flat plate at a temperature of 150 to 400° C. for 30 minutes to 8 hours in a vacuum furnace, and repeating the second flat plate at 50% of reduction rate per one-time rolling to obtain a third flat plate with a thickness of 6 to 40 μm. A rolled copper foil may be simply manufactured by using a milling roller and performing heat-treatment in this method, but a raw material, which is copper tape, is expensive, which results a high manufacturing cost, and a strength of copper tape is low, and thus the tape may be often damaged during a process of roll-milling.

The present invention resolved the problems of the related art and conventional techniques by developing a material that may produce excellent electromagnetic wave shielding effect using a Fe—Cu alloy, which may substitute copper tape, aluminum myler tape, or copper tape-iron tape that has been used to shield electromagnetic waves in copper-cored cables for electrical power or in controlling cables (CVS, CVVS, or CCVS), and thus the present invention has been completed.

SUMMARY

It is an aspect of the present invention to provide an electromagnetic wave shielding Fe—Cu alloy rolled foil that may alternate an electromagnetic wave shielding cable used in copper tape, aluminum myler tape, or copper tape-iron tape that has been conventionally used to shield electromagnetic waves in copper-cored cables for electrical power or in controlling cables (CVS, CVVS, or CCVS).

It is an aspect of the present invention to provide a method for preparing the Fe—Cu alloy rolled foil.

It is an aspect of the present invention to provide an electromagnetic wave shielding Fe—Cu alloy that is used in preparation of a cable having electromagnetic wave shielding characteristics.

It is an aspect of the present invention to provide a method for preparing the Fe—Cu alloy.

The present invention is not limited to the above aspect and other aspects of the present invention will be clearly understood by those skilled in the art from the following description.

In accordance with one aspect of the present invention, a method for preparing a copper ferrous (Fe—Cu) alloy (CFA) rolled foil for shielding electromagnetic waves includes casting a molten metal prepared by melting a material metal, heat-treating the resultant, and roll-milling the heat-treated resultant. In particular, the method comprises a) a molten metal forming process forming a molten metal by melting a Fe—Cu parent alloy and copper (Cu); b) a molten metal coating process adding at least one selected from anhydrous borax and cryolite on a surface of the molten metal; c) a casting process casting the molten metal into a Fe—Cu alloy slab comprising iron at an amount in a range of about 3 wt % to about 30 wt % and copper at an amount in a range of about 70 wt % to about 97 wt %; d) a rough roll-milling process preparing a first panel by rough roll-milling comprising hot-rolling the slab, face milling the hot-rolled slab, and cool-rolling the resultant; e) a heat-treating process preparing a second panel by heat-treating the first panel to remove a remaining stress; and f) a roll-milling process roll-milling the second panel at the total reducing ratio of about 90% or higher by repeating the roll-milling to prepare a thin film having a thickness in a range of about 100 μm to about 10 μm.

In accordance with another aspect of the present invention, an electromagnetic wave shielding Fe—Cu alloy is formed of a Fe—Cu alloy rolled foil containing 3 to 30 wt % of iron and copper accounting for the remaining weight, wherein the Fe—Cu alloy is prepared by using the method for preparing a Fe—Cu alloy (CFA) rolled foil for shielding electromagnetic waves, wherein the method includes the process a) to f) as described above. That is, the electromagnetic wave shielding Fe—Cu alloy rolled foil is formed of an electromagnetic wave shielding Fe—Cu alloy (CFA) including 3 to 30 wt % of iron and 70 to 97 wt % of copper, which produces electromagnetic wave shielding effect of about 80 dB or higher within a high frequency range of about 1 GHz to about 1.5 GHz and has a thickness in a range of about 100 μm to about 10 μm.

The a) molten metal forming process includes melting a Fe—Cu parent alloy and a metal copper (Cu) as raw material metals. Since the melting may be performed at a melting temperature decreased to 1300° C. by using the Fe—Cu parent alloy as one of the raw material metals, problems such as excessive oxidation of iron, erosion of a furnace wall, and limitation in use of a jig that may occur by melting iron at a high temperature of 1539° C., a melting point of iron, may be resolved.

The Fe—Cu parent alloy may be prepared by a method generally known in the art. For example, copper and a flux may be added and dissolved in a molten metal, in which iron is completely melted, and then the flux on a surface of the molten metal may be removed. The molten metal may be solidified to prepare a Fe—Cu parent alloy ingot, wherein the Fe—Cu parent alloy may preferably include amounts of iron and copper a weight ratio of 50:50 or 40:60.

Also, in order to prepare a Fe—Cu alloy containing 3 to 30 wt % of iron and copper accounting for the remaining weight according to an embodiment of the present invention, an insertion ratio of a metal copper (Cu) that is melted together with the Fe—Cu parent alloy needs to be added within a range that may maintain the content ratio of iron and copper, and thus the insertion ratio of a metal copper (Cu) is determined according to an amount of the Fe—Cu parent alloy.

The anhydrous borax or cryolite used in the b) molten metal coating process are a molten metal surface covering material that covers surfaces of the molten raw material metals and prevents oxidation of iron. A melting temperature of iron is high, and thus iron may be easily oxidized, and, in particular, an iron oxide, $Fe_2O_3$ or $Fe_3O_4$, exists as a non-metallic inclusion which may break a rolling plate during a hot roll-milling process, and thus surface coating of the molten metal needs to be thoroughly performed so that oxidation of iron may not occur during a casting process. When copper is melted, in general, a carbon flux or charcoal may be used to cover the molten metal, but when the carbon flux or charcoal is used as a covering material on the Fe—Cu alloy, a carbon component in the carbon flux or charcoal binds with iron and forms FeC or $Fe_3C$, which decreases a conducting ratio and simultaneously reduces a function of shielding electromagnetic waves.

In the present invention, oxidation of iron may be prevented by covering a surface of a molten metal using anhydrous borax or cryolite, and a covering material may be added at a ratio in a range of about 0.1 part to about 0.5 parts by weight based on 100 parts by weight of the Fe—Cu parent alloy.

The rough roll-milling process is a pre-treatment step to form a first flat plate appropriate for roll-milling. In the d) heat-treating process, the first flat plate obtained from the e) rough roll-milling process is heat-treated to maximize electromagnetic wave shielding characteristics of the Fe—Cu alloy, and conditions for the heat-treatment includes a nitrogen atmosphere or a nitrogen atmosphere containing hydrogen at a volume unit in a range of about 0.1% to about 10% within a temperature range of about 300° C. to about 800° C. for about 3 hours to about 21 hours; or within a temperature range of about 300° C. to about 800° C. for about 1 hour to about 7 hours three times so that a hardness of the panel is in a range of about ¼H to about ½H.

The f) roll-milling process is performed at a roll-milling ratio that maximizes the electromagnetic wave shielding effect, and the panel may be repeatedly roll-milled five to six times so that the total reducing ratio is about 90% or higher and may be prepared as a thin film having a thickness in a range of about 100 μm to about 10 μm. The roll-milling process may be performed by using a general multi-pass rolling mill, for example, a 20-stage rolling mill, to prepare a thin film having a thickness in a range of about 100 μm to about 10 μm.

In accordance with another aspect of the present invention, a cable having electromagnetic wave shielding characteristics is prepared by using a Fe—Cu alloy (CFA) rolled foil containing 3 to 30 wt % of iron and copper accounting for the remaining weight and having a thickness in a range of about 100 μm to about 10 μm by undergoing the a) molten metal forming process through the f) multi-pass roll-milling process. A cable generally includes a central conducting body, an insulating layer and an external covering layer, and the cable having electromagnetic wave shielding characteristics is prepared by taping an external part of the insulating layer with the Fe—Cu alloy (CFA) rolled foil containing 3 to 30 wt % of iron and copper accounting for the remaining weight and having a thickness in a range of about 100 μm to about 10 μm to form an electromagnetic wave shielding layer; and then forming the external covering layer.

DETAILED DESCRIPTION

Hereinafter, embodiments of the present invention will be described in detail with reference to the accompanying drawings. It should be understood that the present invention is not limited to the following embodiments, and that the embodiments are provided for illustrative purposes only. The scope of the invention should be defined only by the accompanying claims and equivalents thereof.

<Example 1> Casting Slab of Fe—Cu Alloy (10Fe-90Cu; CFA90)

150 kg of a Fe—Cu parent alloy (50Fe-50Cu) ingot was inserted into a high frequency induction furnace, electricity was applied thereto to completely dissolve the ingot, 600 kg of metal copper was inserted thereto, and 300 g of a flux was continuously added thereto to increase a molten metal temperature to 1400° C. Then, supply of electricity was ceased, and the resultant was de-acidified. After about 5 minutes, the resultant was moved to a mold at a temperature of 1300° C. by using a vertical continuous casting method while maintaining the flux on a surface of the resultant to prepare a slab having a thickness of 150 mm, a width of 300 mm, and a length of 2000 mm.

<Example 2> Preparation of Fe—Cu Alloy (10Fe-90Cu; CFA90) Rolled Foil Having a Thickness of 0.1 T The slab prepared in Example 1 was hot-rolled and face-milled by using a general method to have a thickness of 12 mm, and rough roll-milled at a thickness of 1 mm in a cool-rolling device to obtain a first flat plate, and the first flat panel was heat-treated in a nitrogen atmosphere within a temperature range of about 300° C. to about 800° C. for 20 hours to obtain a second flat panel.

Figure 3:
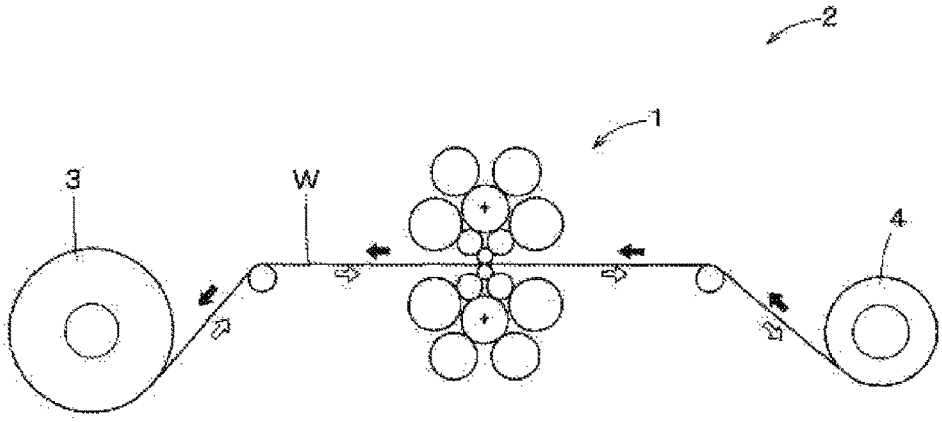
FIG. 3 is a schematic view of a 20-step multi-pass rolling mill.

The second flat panel was used as a roll-milling material which was sequentially roll-milled to have a thickness which changed from 1T→0.7T→0.4T→0.28T→0.2T→0.14T→0.1T by using a 20-stage rolling mill as shown in [FIG. 3], and thus a Fe—Cu alloy (10Fe-90Cu; CFA90) rolled foil having a thickness of 0.1 T with a total reduction ratio of 90% was prepared.

<Example 3> Preparation of Fe—Cu Alloy (10Fe-90Cu; CFA90) Rolled Foil Having Thickness of 10 μm The slab prepared in Example 1 was hot-rolled and face-milled by using a general method to have a thickness of 1 mm, and rough roll-milled at a thickness of 0.1 mm in a cool-rolling device to obtain a first flat plate, and the first flat panel was heat-treated in a nitrogen atmosphere within a temperature range of about 300° C. to about 800° C. for 20 hours to obtain a second flat panel.

Then, the second flat panel was roll-milled, and thus a Fe—Cu alloy (10Fe-90Cu; CFA90) rolled foil having a thickness of 0.01 T (10 μm) with a total reduction ratio of 90% was prepared in the same manner as in Example 2.

The multi-pass rolling mill used in Example 2 and Example 3 may be schematically described as follows. As shown in FIG. 3, a roll-milling device 2 has an unrolling unit 3 that unrolls a roll-milling material W; and a rolling unit 4 that rolls the roll-milling material W, and a multi-pass rolling mill 1 that roll-mills the roll-milling material W is disposed between the unrolling unit 3 and the rolling unit 4. The multi-pass rolling mill 1 allows reverse roll-milling as the roll-milling material W may move forward or backward by converting a panel passing direction (by reversing a panel passing direction between the black arrow and the white arrow shown in FIG. 3).

Evaluation Examples 1 and 2

Electromagnetic wave shielding effect of each of the Fe—Cu alloy (10Fe-90Cu; CFA90) rolled foils having a thickness of 0.1 T or 0.01 T (10 μm) prepared in Example 2 and Example 3 was evaluated, and the results are shown in FIG. 1 and FIG. 2.

Figure 1:
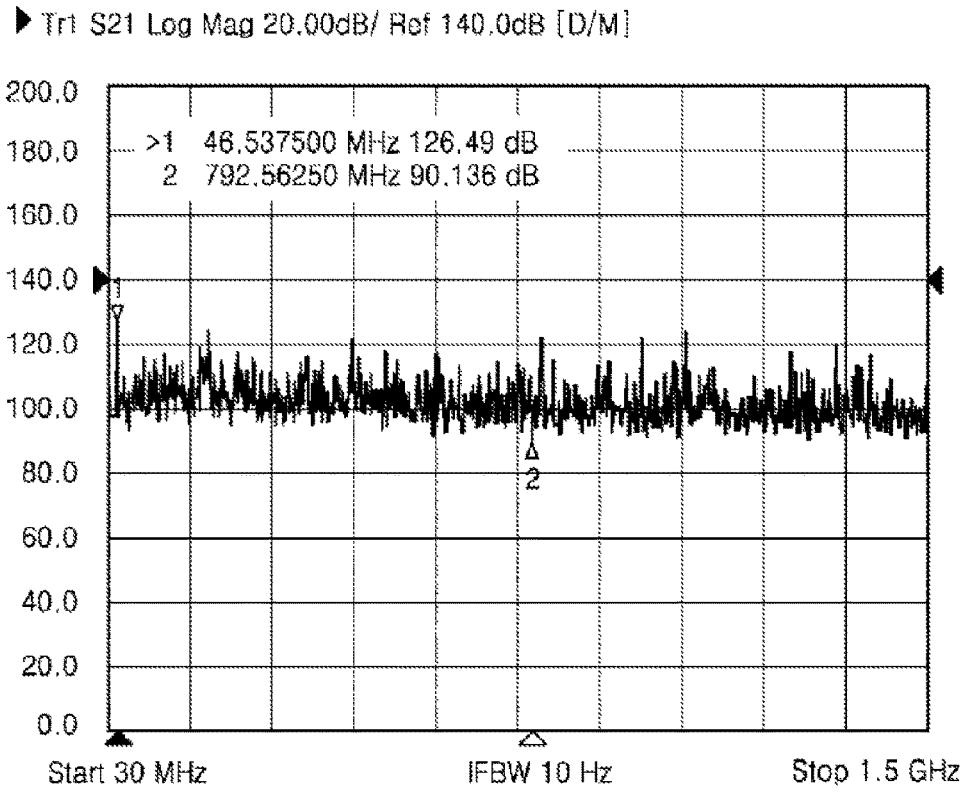
FIG. 1 is a graph of an electromagnetic wave shielding effect of 0.1 T rolled foil of a copper ferrous alloy (CFA90) according to an embodiment of the present invention.
Figure 2:
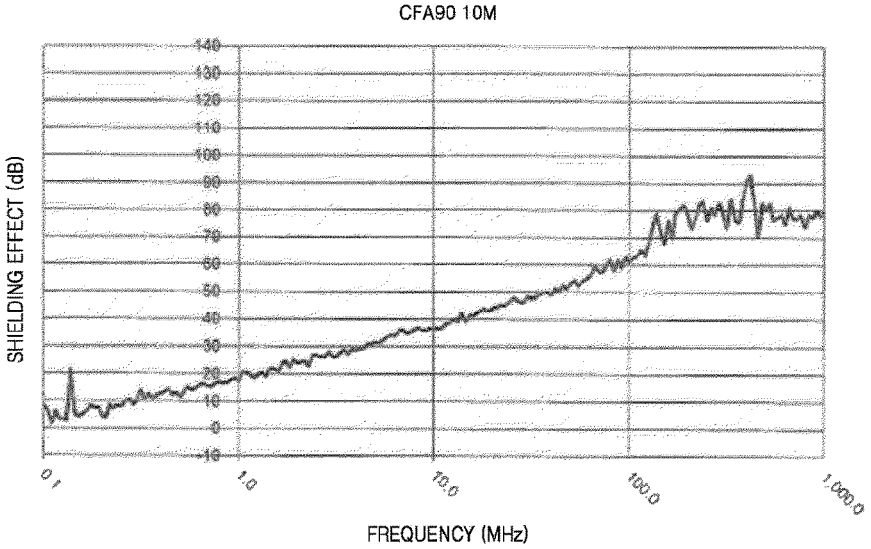
FIG. 2 is a graph illustrating the electromagnetic wave shielding effect of a 10 μm-thick rolled foil of CFA90.

FIG. 1 is the graph of electromagnetic wave shielding effect of the Fe—Cu alloy (10Fe-90Cu; CFA90) rolled foil having a thickness of 0.1 T. The graph above shows the results measured by reference to the specification and test methods ASTM D4935-10 form the Korea Testing Laboratory. and FIG. 2 shows a graph illustrating the measurement results of electromagnetic wave shielding effect of the Fe—Cu alloy (10Fe-90Cu; CFA90) rolled foil having a thickness of 10 μm. Referring to the measurement results shown in FIG. 1 and FIG. 2, it may be confirmed that the Fe—Cu alloy rolled foil of the present invention provides an electromagnetic wave shielding effect of 80 dB or higher at a high frequency range between 1 GHz to 1.5 GHz. Thus, in consideration of a copper material providing an electromagnetic wave shielding effect of 30 dB or lower, it may be known that the electromagnetic wave shielding effect of the Fe—Cu alloy rolled foil of the present invention is very good.

For additional information, when the electromagnetic wave shielding effects 80 dB and 30 dB are compared according to Equation in which an electromagnetic wave shielding effect is represented in %, the Fe—Cu alloy rolled foil of the present invention is calculated as having 100000 greater electromagnetic wave shielding effect that of copper.

$$\text{Electromagnetic wave shielding effect (\%)} = (1-10^{-A/10})\times 100 \quad \text{[Equation]}$$

(where, A is dB)

That is, according to Equation, an electromagnetic wave shielding effect (%) of 80 dB is 99.999999%, and an electromagnetic wave shielding effect (%) of 30 dB is 99.9%. Thus, there are differences of 0.000001% transmission and 0.1% transmission based on 100% of the complete shielding effect, which denotes that in terms of electromagnetic wave shielding effect, 80 dB is 100000 better than 30 dB.

As described above, according to one or more embodiments of the present invention, a copper ferrous (Fe—Cu) alloy containing 3 to 30 wt % of iron and copper accounting for the remaining weight may form a thin film by roll-milling the Fe—Cu alloy with a high reduction ratio to maximize electromagnetic wave shielding effect. An electromagnetic wave shielding cable prepared by using the Fe—Cu alloy rolled foil has high strength, improved corrosion-resistance, and improved function of shielding electromagnetic waves compared to those of conventional cables using copper, aluminum, or iron as a shielding material. Also, a manufacturing process of the electromagnetic wave shielding cable is simple, and thus productivity of the process may increase and a manufacturing cost of the cable may decrease. Moreover, the Fe—Cu alloy rolled foil provides an electromagnetic wave shielding effect of 80 dB or higher within a high frequency range between 1 GHz to 1.5 GHz, which denotes that the electromagnetic wave shielding effect of the Fe—Cu alloy rolled foil of the present invention is significantly good in consideration of an electromagnetic wave shielding effect of copper, which is 30 dB or lower, thereby making it possible to control malfunction caused by noise in circuits of precision machines, robots, and automobiles, etc. and reduce noise in mobile phones. Accordingly, the Fe—Cu alloy rolled foil may be widely utilized as a material for shielding electromagnetic waves.

What is claimed is:

1. A method for preparing a copper ferrous (Fe—Cu) alloy (CFA) rolled foil for shielding electromagnetic waves, the method comprising:

a) a molten metal forming process forming a molten metal by melting a Fe—Cu parent alloy and copper (Cu) comprising iron at an amount in a range of about 5 wt % to about 20 wt % and copper at an amount in a range of about 80 wt % to about 95 wt %;

b) a molten metal coating process adding at least one selected from anhydrous borax and cryolite on a surface of the molten metal;

c) a casting process casting the molten metal into a Fe—Cu alloy slab;

d) a rough roll-milling process preparing a first panel by rough roll-milling comprising hot-rolling the slab, face-milling the hot-rolled slab, and cool-rolling the resultant;

e) a heat-treating process preparing a second panel by heat-treating the first panel to remove a remaining stress; and f) a roll-milling process roll-milling the second panel at a total reducing ratio of about 90% or higher by repeating the roll-milling to prepare a thin film having a thickness in a range of about 100 μM to about 10 μm.

2. The method according to claim 1, wherein a weight ratio of iron and copper in the Fe—Cu parent alloy used in a) the molten metal forming process is about 50:50 or about 40:60.

3. The method according to claim 2, wherein e) the heat-treating process is performed in a nitrogen atmosphere or a nitrogen atmosphere containing hydrogen at a volume unit in a range of about 0.1% to about 10% within a temperature range of about 300° C. to about 800° C. for about 3 hours to about 21 hours; or performed within a temperature range of about 300° C. to about 800° C. for about 1 hour to about 7 hours three times so that a hardness of the second panel is in a range of about ¼H to about ½H.

4. The method according to claim 3, wherein f) the roll-milling process is characterized in repeating the roll-milling five to six times by using a multi-pass rolling mill.

5. A electromagnetic wave shielding copper ferrous alloy (CFA) comprising iron at an amount in a range of about 5 wt % to about 20 wt % and copper at an amount in a range of about 80 wt % to about 95 wt %, wherein the CFA is prepared by using the method according to claim 4.

* * * * *